US006024427A

United States Patent [19]

Underwood et al.

[11] Patent Number: 6,024,427

[45] Date of Patent: Feb. 15, 2000

[54] MOBILE OFFICE FURNITURE PEDESTAL UNIT WITH HANDLE AND AUXILIARY WORKSURFACE AND STORAGE

[75] Inventors: Robert A. Underwood, Jasper; J. Douglas Mitchell, Newburgh, both of Ind.

[73] Assignee: Kimball International, Inc., Jasper, Ind.

[21] Appl. No.: 09/063,912

[22] Filed: Apr. 21, 1998

[51] Int. Cl.[7] ..... A47B 46/00

[52] U.S. Cl. ..... 312/249.12; 312/280; 280/47.35; 280/47.371

[58] Field of Search ..... 248/284.1; 312/196, 312/223.3, 280, 281, 282, 249.11, 249.12, 249.8, 249.13, 140.4, 233, 266, 298, 325, 327; 108/92, 94, 28, 42, 29, 50.01, 102, 137, 138; 280/47.35, 47.371, 47.36, 651, 655.1

[56] References Cited

U.S. PATENT DOCUMENTS

| | | | |
|---|---|---|---|
| 317,766 | 5/1885 | Groves | 312/282 X |
| 806,304 | 12/1905 | Street | 312/325 X |
| 875,170 | 12/1907 | Gramelspacher . | |
| 2,042,387 | 5/1936 | Cobb | 280/47.35 X |
| 2,383,058 | 8/1945 | Hanson | 312/266 X |
| 2,778,704 | 1/1957 | Joachim | 312/249.12 X |
| 2,981,549 | 4/1961 | Hotton . | |
| 3,726,237 | 4/1973 | Devey et al. | 108/92 |
| 3,756,679 | 9/1973 | Schoenfelder | 108/29 X |
| 3,856,320 | 12/1974 | Blanchard . | |
| 4,588,237 | 5/1986 | Marder . | |
| 4,795,186 | 1/1989 | Tyus | 280/655.1 |
| 4,924,782 | 5/1990 | Nichoalds . | |
| 4,989,291 | 2/1991 | Parent . | |
| 5,028,099 | 7/1991 | Bertucco | 312/249.12 |
| 5,253,757 | 10/1993 | Locker . | |
| 5,348,324 | 9/1994 | Trotta . | |
| 5,427,394 | 6/1995 | Lauto . | |
| 5,542,635 | 8/1996 | Smith et al. . | |
| 5,584,546 | 12/1996 | Gurin et al. . | |
| 5,660,450 | 8/1997 | Huang | 312/194 |
| 5,680,914 | 10/1997 | Reiser | 190/11 |

FOREIGN PATENT DOCUMENTS

| | | | |
|---|---|---|---|
| 5-254444 | 10/1993 | Japan | 280/47.371 |

*Primary Examiner*—Peter M. Cuomo
*Assistant Examiner*—Janet M. Wilkens
*Attorney, Agent, or Firm*—Baker & Daniels

[57] ABSTRACT

A mobile pedestal unit having a pivotally attached arm member with a grip. The grip can be placed in a projecting position above and outwardly of an upper edge of the unit where the grip can be conveniently grasped to move the mobile pedestal unit. The grip can also be positioned above and only slightly beyond an opposite upper edge of the unit in a storage position. In the storage position the floor area required by the unit is reduced and the storage of the unit under a worksurface panel is thereby facilitated. An auxiliary platform can also be rotatably attached to the arm member. The auxiliary platform may be used as a secondary worksurface panel or shelf when oriented substantially horizontally or serve as a bookstop when allowed to hang freely in a substantially vertical orientation outwardly adjacent an upper edge of the mobile pedestal unit. A retractable U-shaped file hanger which is slidable between a position flush with the exterior surface of the unit and an extended position may also be provided. In the extended position the parallel rails of the U-shaped file hanger provide readily accessed temporary or supplemental file storage.

29 Claims, 6 Drawing Sheets

MOBILE OFFICE FURNITURE PEDESTAL UNIT WITH HANDLE AND AUXILIARY WORKSURFACE AND STORAGE

BACKGROUND OF THE INVENTION

The present invention relates generally to furniture units and more particularly to mobile pedestal units.

Mobile furniture units, such as pedestal units, short file cabinets, carts, and the like are widely used in office applications and derive significant benefits from their transportability. Such mobile pedestal units can be used for a variety of different functions, such as transporting files from one location to the next, as a movable secondary work station, or as an auxiliary storage cabinet.

One drawback of conventional mobile pedestal units is that they normally have a height which does not exceed the lower thigh of a standing person. Thus, a person is forced to bend over in an awkward and uncomfortable position when pushing the unit. This can result in back pain, fatigue, and a concomitant loss in productivity.

Another drawback of conventional mobile pedestal units is that they are typically provided with a limited upper surface area. This limited area can quickly become cluttered, resulting in items falling from the surface when the unit is moved and limiting the amount of work items or files which can be placed on the upper surface. Furthermore, the top surface of these prior art mobile pedestal units is typically too low to be comfortably used as a secondary worksurface by a person sitting on a conventional office chair.

SUMMARY OF THE INVENTION

The present invention provides an improved mobile pedestal unit which includes a handle disposed above its upper worksurface, an auxiliary worksurface platform and supplementary storage capabilities.

In one form, the invention provides a mobile pedestal unit with one or more drawers and casters for providing mobility. A handle with a grip is pivotally attached to the mobile pedestal unit with a pair of arms. The handle is movable between a forward projecting position and a rear storage position. The arms each have a support member, or standoff, connected thereto which supports the handle assembly in each of the two positions.

In the forward projecting position, the arms project the handle above and beyond the front face of the mobile pedestal unit. When in the forward projecting position, the handle can be conveniently used to push the mobile pedestal unit in a manner analogous to pushing a shopping cart. In the rear storage position, the handle is positioned above and only slightly rearward of the rear face of the mobile pedestal unit. In this rear position, the mobile pedestal unit can be conveniently stored under another worksurface, such as a conventional desk.

In another form of the invention, an auxiliary platform is rotatably attached to the handle. The platform is rotatable between a substantially horizontal position and a substantially vertical position. When the handle is in either the forward or rear position, the auxiliary platform may be rotated to a substantially horizontal position with the free end of the platform engaging the support members attached to the arms.

With the handle in the forward projecting position, the platform projects beyond the forward face of the mobile pedestal unit when in the horizontal position and can serve as a secondary worksurface for such tasks as data entry into a laptop computer. In such a position, the platform is substantially parallel to and elevated above the top surface of the mobile pedestal unit and the platform extends beyond the front face of the mobile pedestal unit. Thus, a person using the platform as an auxiliary worksurface has "leg room" and can be seated comfortably while using the platform as an auxiliary worksurface.

The platform can also be oriented in a substantially horizontal position with the handle positioned in its rear position. In such a position, the platform is elevated above and substantially parallel to the top surface of the mobile pedestal unit and may be used as a shelf.

The auxiliary platform may also be allowed to hang freely from the handle in a substantially vertical orientation. When the handle is in the rear position and the platform is allowed to hang freely, the free end of the platform is in contact with the rear face of the mobile pedestal unit and the platform can serve as a bookstop. In either the vertical or horizontal orientations of the platform with the handle in the rear position, the handle and platform extend only slightly beyond the rear face of the mobile pedestal unit. Thus, the unit can be conveniently stored under a primary worksurface, such as a conventional desk.

In another form of the invention, an exterior, supplemental file hanger is provided with the mobile pedestal unit. The file hanger is formed by a horizontally oriented, substantially U-shaped member. The U-shaped member is slidable between a retracted position where it is substantially flush with the exterior surface of the mobile pedestal unit, and an extended position which enables hanging files to be supported on the U-shaped member.

One advantage of the present invention is that it provides a conveniently placed handle so that the user can conveniently move the mobile pedestal unit by grasping the handle instead of the sides or top of the worksurface.

Another advantage of the present invention is that the handle is movable to a position in which the floor area required by the mobile pedestal unit is minimized and the handle is disposed adjacent a rear surface of the unit thereby facilitating the placement of the unit under a primary worksurface panel.

Yet another advantage of the present invention is that it provides an auxiliary platform which can be used as a secondary worksurface, a shelf, or a book stop.

Still another advantage of the present invention is that it provides readily accessible supplementary file storage.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
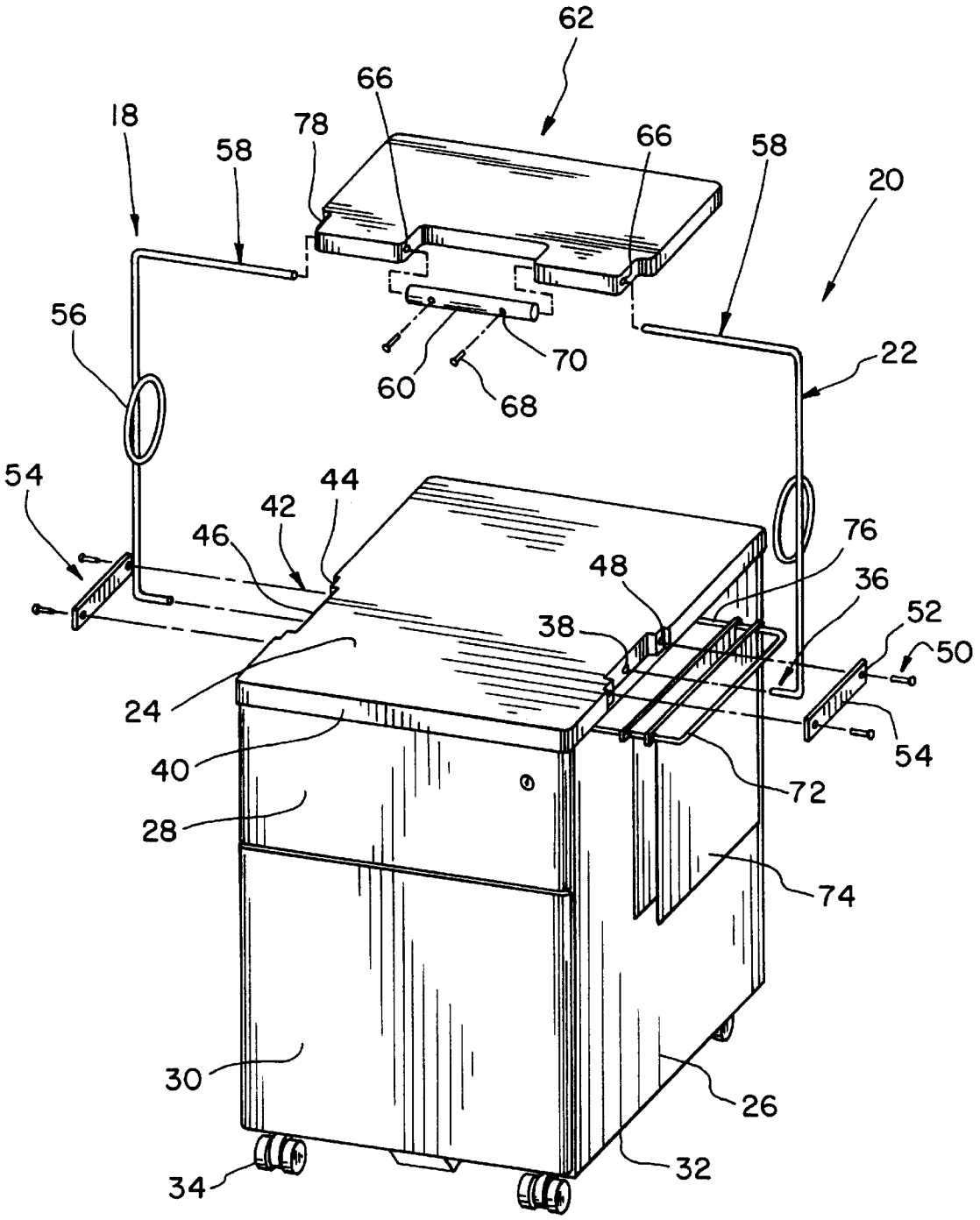
FIG. 1 is a partially exploded perspective view of a mobile pedestal unit embodying the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates one preferred embodiment of the invention, in one form, and such exemplification is not intended to be an exhaustive illustration of the invention or to be construed as limiting the scope of the invention.

DETAILED DESCRIPTION OF THE INVENTION

Figure 2:
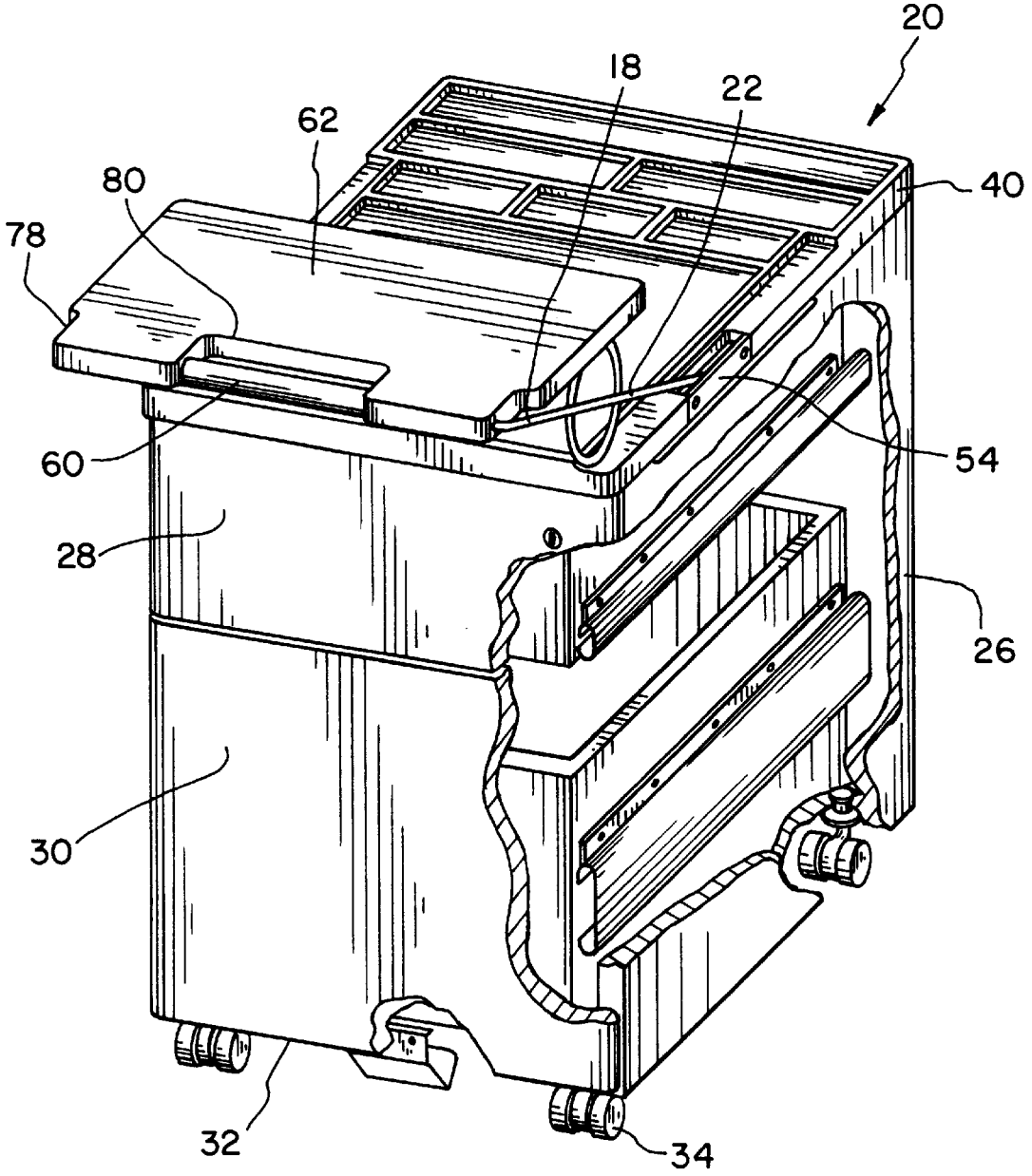
FIG. 2 is a perspective view of the mobile pedestal unit with the view of the mobile pedestal unit body partially broken away.

An exemplary embodiment of the invention is shown in the drawings, in particular by referring to FIGS. 1 and 2 in which mobile pedestal unit 20 is shown having a base structure comprised of an upper surface 24, exterior side surfaces 26, box drawer 28 and file drawer 30 having means therein for suspending file folders. Wheeled casters 34 are attached to bottom surface 32 and provide mobility and support for the mobile pedestal unit. A pivotable arm member 18 is provided for use with the mobile pedestal unit. FIGS. 1 and 2 also show an auxiliary platform 62 rotatably attached to arm member 18.

As shown in FIG. 1, top panel 40 of the mobile pedestal unit is generally rectangular in shape. Two double-tiered notches 42 are located on oppositely disposed edges of the top panel 40. Flat surfaces 44 form a first tier on each end of notch 42. Pilot holes 48 are located on flat surfaces 44. A middle section 46 is located in the center of notch 42 and forms the second tier of notch 42. Cylindrical bores 38 are located in the center of sections 46 and bores 38 are aligned with each other. As shown in FIG. 1, arm members 18 include a pintle 36 at one end, a pivot arm section 22 and a grip extension 58 at the other end. Pintles 36 are rotatably received in cylindrical bores 38. The diameter of bore 38 is only slightly larger than the diameter of pintle 36, so that when pintles 36 are inserted into bores 38, the inside surface of bores 38 engages the outside surface of pintles 36, yet pintles 36 are still rotatable withinbores 38.

After pintles 36 are inserted into bores 38, arm members 18 are secured to mobile pedestal unit 20 by placing retainer plates 54 against surfaces 44 and aligning apertures 52 with pilot holes 48. Wood screws 50 are inserted through apertures 52 and engaged with pilot holes 48 in top panel 40 to thereby secure retainer plates 54 against the side of top panel 40 in notches 42. Retainer plates 54, in turn, secure pintles 36 in bores 38. The assembled unit is shown in FIG. 2, and the arm members 18 are pivotable about the common axis defined by bores 38.

As shown in FIG. 1, grip extensions 58 are received into cylindrical coupling sleeve 60, which both connects the arm members 18 together and acts as a grip cover. Alternatively, grip extensions 58 could be formed as a one-piece member which connects pivot arms 22.

Figure 3:
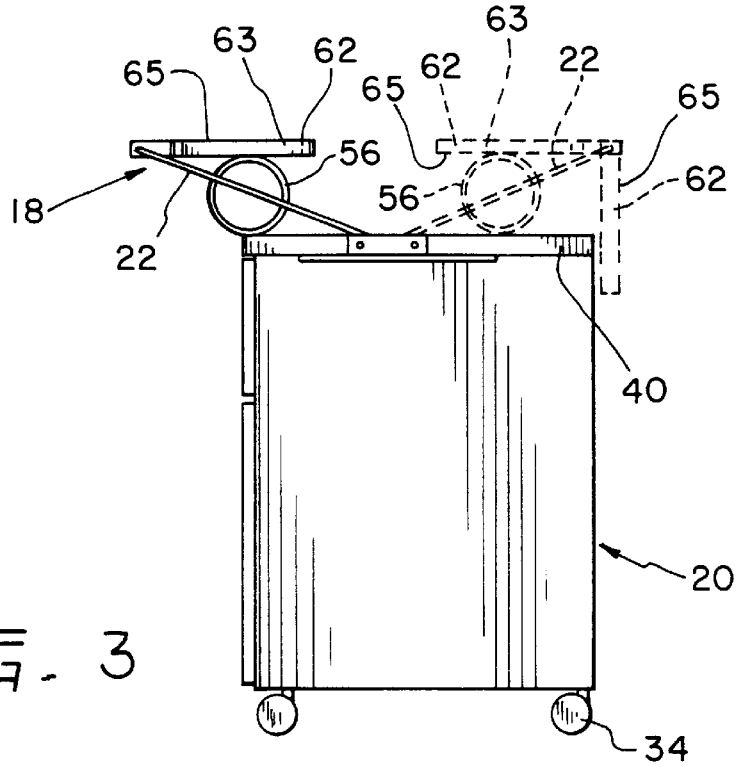
FIG. 3 is a side elevational view of the mobile pedestal unit, showing an arm member in a projecting position and, in dashed lines, showing the arm member in a storage position.
Figure 4:
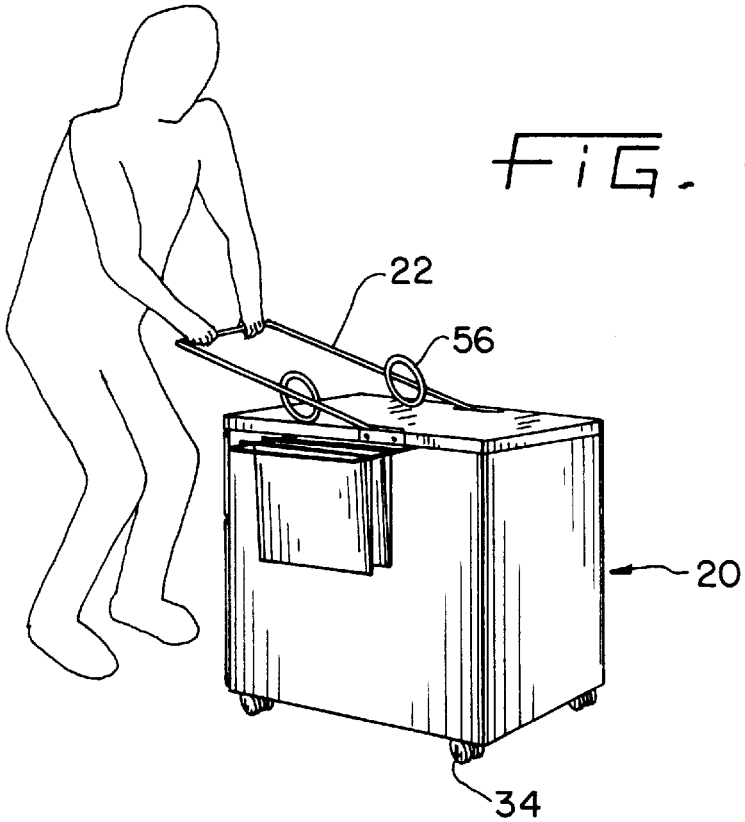
FIG. 4 is a perspective view of the mobile pedestal unit being moved by a person.

As seen in FIG. 3, pivot arms 22 are pivotable between two positions. In the first position, illustrated in solid lines in FIG. 3, arm member 18 is in a projecting position in which grip extensions 58 and sleeve 60 (not shown in FIG. 3) are positioned above and outwardly of a forward edge of top panel 40. In this projecting position, sleeve 60 can be easily grasped and the mobile pedestal unit can be conveniently pushed or pulled by a person, much like a grocery cart as shown in FIG. 4. In the illustrated embodiment, the top surface 24 of panel 40 is approximately 22 inches above the floor while sleeve 60 is approximately 5 inches above top surface 24 when in the projecting position.

Figure 5:
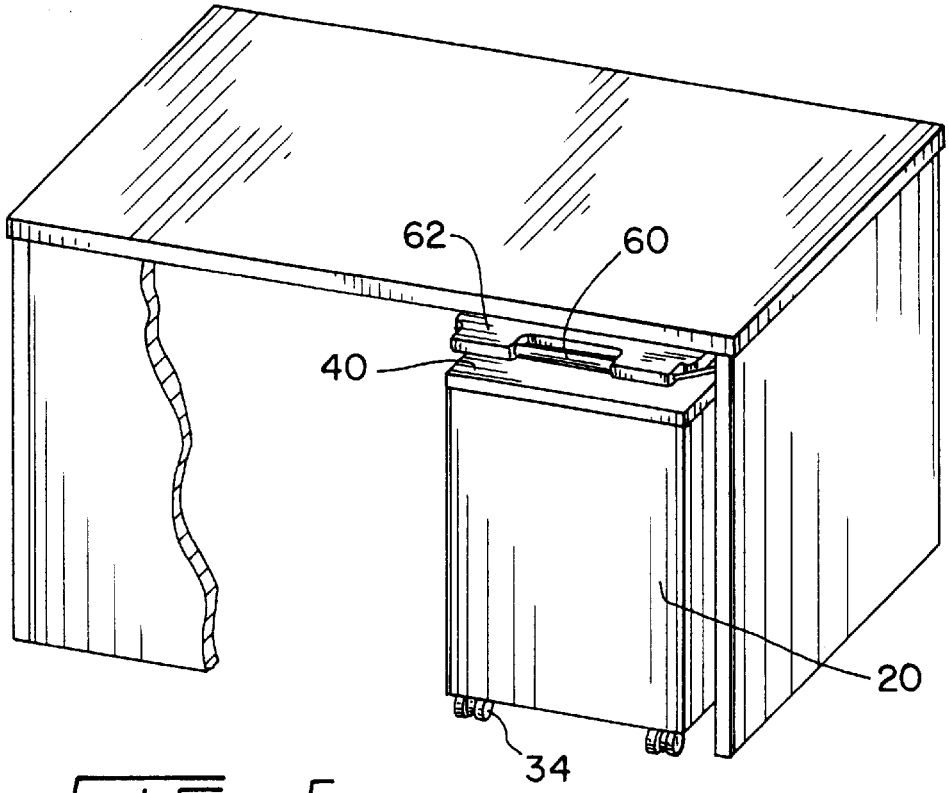
FIG. 5 is a perspective view of the mobile pedestal unit stored under a desk.

As shown in dashed lines in FIG. 3, arm member 18 can also be pivoted about the common axis defined by bores 38 to a second position. In this second, storage position, grip extensions 58 and sleeve 60 (not shown in FIG. 3) are disposed relatively proximate the rear edge of top panel 40. The grip extensions 58 and sleeve 60 are disposed above and only slightly beyond the rear edge of top panel 40 in this storage position thereby minimizing the floor area required for mobile pedestal unit 20. This reduced floor area requirement facilitates the storage of mobile pedestal unit 20 under a worksurface panel as shown in FIG. 5. Conventionally, mobile pedestal unit 20 would be positioned under a desk so that drawers 28 and 30 face the user of the desk and FIG. 5 is a view of a desk with the rear panel partially broken away to show the rear surface of mobile pedestal unit 20 opposite drawers 28, 30.

As can be seen in the figures, the common pivot axis defined by bores 38 is spaced a first distance from the front edge of the pedestal unit body and a second greater distance from the rear edge of the pedestal unit body as can be particularly seen in FIG. 3. With further reference to FIG. 3 it can also be appreciated that this first/common axis is spaced from the rear edge at a distance approximately equivalent to the length between the grip portion of the arm member and the first axis.

A circular support or standoff 56 is attached to each of the pivot arm sections 22 and engages top surface 24 to allow a user to selectively position arm member 18 in the projecting and storage positions described above. Illustrated supports 56 are formed of a loop of metal material and can be secured to arm 22 by any suitable means such as welding, bolts, or the like or can be integrally formed with pivot arms 22. Two portions of the outer circumferential surface of support 56 may be placed in bearing contact with top surface 24. Different portions of the outer circumferential surface located on opposite sides of pivot arms 22 are in contact with top surface 24 when arm member 18 is in the projecting and storage positions illustrated in FIG. 3. By pivoting arm member 18 a user may selectively engage one of these bearing surfaces located on the outer circumferential surface of support 56 with the top panel 40. Supports 56 may thereby be used to selectively support arm member 18 in either a projecting position or a storage position. Alternatively, support surfaces attached to the base structure of mobile pedestal unit 20 could be located on both sides of the axis defined by bores 38 and be positioned to engage and thereby support arm member 18 in the desired positions. In some embodiments, fasteners 50 could serve this function.

Mobile pedestal unit 20 may also include an auxiliary platform 62 attached to grip extensions 58. As seen in FIG. 1, grip extensions 58 are inserted through openings 66 in platform 62 and are received in coupling sleeve 60. Bolts 68 are installed through threaded apertures 70 to secure the assembly of grip extensions 58, sleeve 60, and platform 62. The diameter of openings 66 is sufficiently larger than the diameter of grip extensions 58 so that platform 62 is rotatable with respect to arm member 18.

In the illustrated embodiment, platform 62 has recessed comers 78 at the point where pivot arms 22 are inserted through platform 62. Platform 62 also includes a rectangular recess 80 in which sleeve 60 is located.

Platform 62 rotates about a panel axis defined by grip extensions 58. In the illustrated embodiment the panel axis defined by grip extensions 58 is disposed parallel to the common axis about which arms 22 are pivoted. As seen in FIG. 3, pivotal movement of pivot arms 22 can engage support 56 with the base structure of mobile pedestal unit 20 in two different locations on the base structure of unit 20 and at two different locations on support 56. In either of these two different positions, when the free end of platform 62 is rotated towards the center of unit 20 to a horizontal position, free end 63 of platform 62 is engaged and supported by a portion of the outer circumferential surface of support 56.

Thus, it can be appreciated that the auxiliary platform 62 is movable to a first position wherein support 56 engages a first side 65 of the auxiliary platform 62 to thereby support auxiliary platform 62 in a substantially horizontal orientation as shown in FIG. 3 in phantom. Further, auxiliary platform 62 is movable to a second position wherein first side 65 faces away from the support 56 and platform 62 is oriented substantially vertically, as also shown in phantom in FIG. 3. As also shown in FIG. 3, platform 62 is also moveable to a third position wherein side 65 faces away from support 56 and platform 62 is oriented substantially horizontally.

Figure 7:
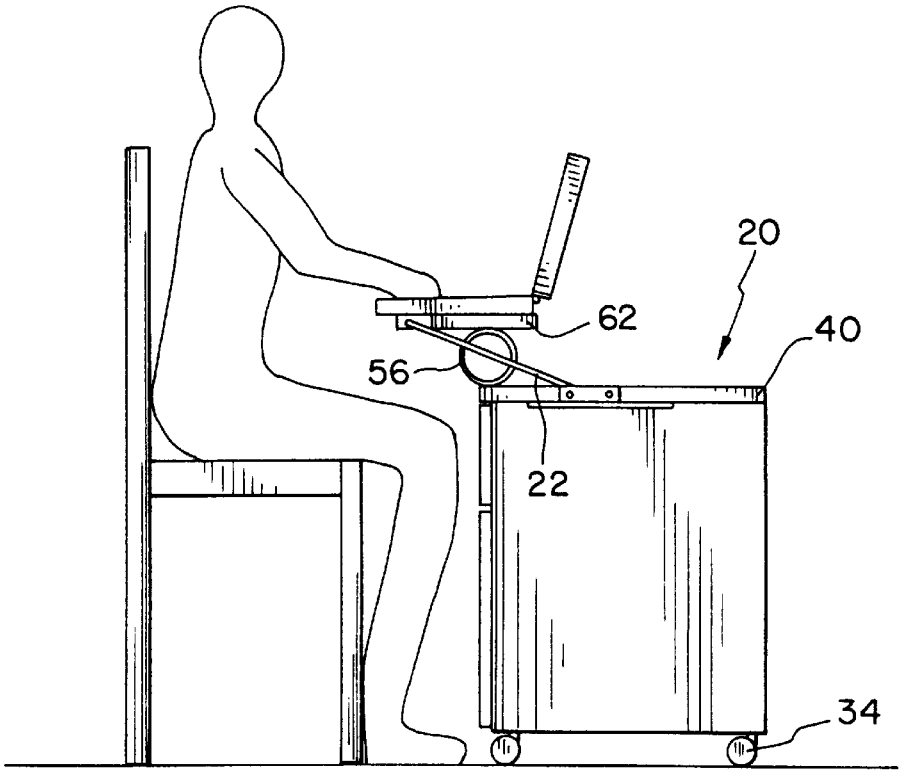
FIG. 7 is a side elevational view of the mobile pedestal unit and a seated person using the auxiliary platform as a worksurface.
Figure 6:
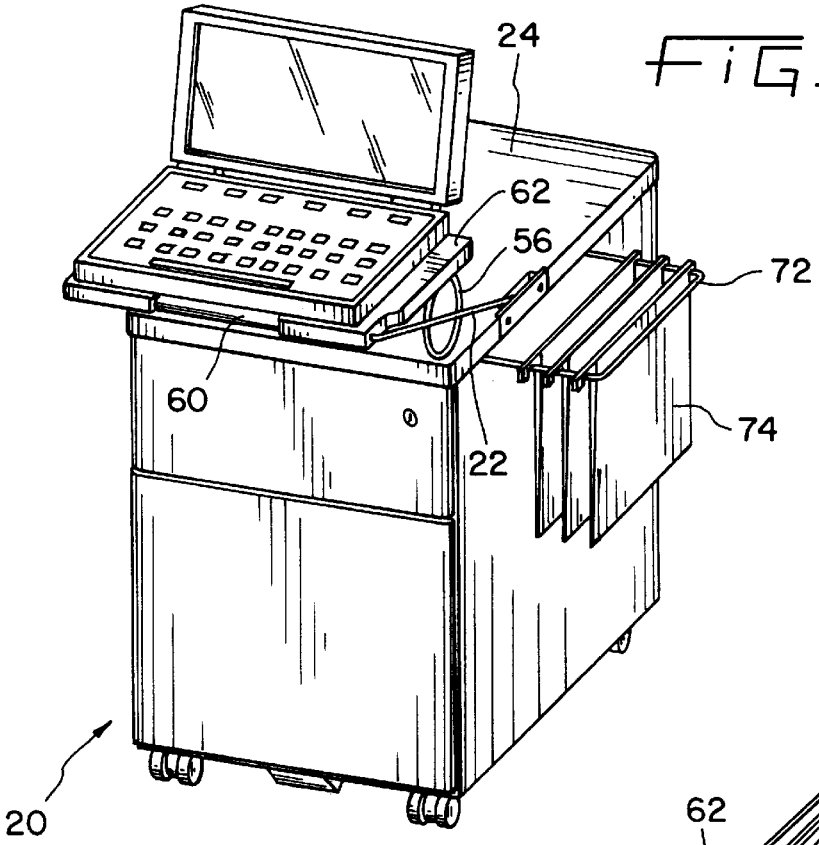
FIG. 6 is a perspective view of the mobile pedestal unit with the auxiliary platform positioned for use as a worksurface.

When arm member 18 is in a projecting position and platform 62 is rotated to a horizontal position, platform 62 may function as a secondary worksurface for such tasks as, for example, data entry into a laptop computer as shown in FIGS. 6 and 7. As best seen in FIG. 7, with platform 62 rotated to a horizontal position and arm member 18 in a projecting position, the user has "leg room" beneath platform 62 thereby eliminating the discomfort caused by using a worksurface which does permit a user's legs to be positioned beneath the worksurface. Additionally, the leg room provided beneath the grip portion of arm member 18 provided by placing arm member 18 in a projecting position provides a "kick space" beneath sleeve 60. This "kick space" allows a person to push or pull the mobile pedestal unit using sleeve 60 in greater comfort and reduces the possibility of accidently kicking unit 20.

Figure 8:
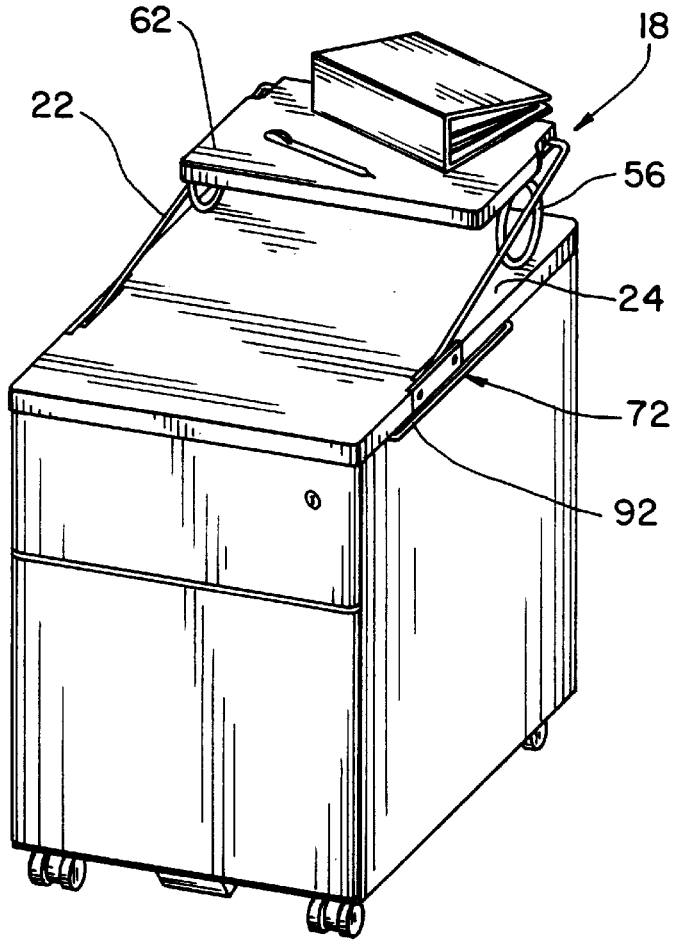
FIG. 8 is a perspective view of the mobile pedestal unit with the auxiliary platform being used as a shelf.

When arm member 18 is in a storage position and platform 62 is rotated to a horizontal position as shown in FIG. 8, platform 62 may be used as a shelf. In this position, free end 63 is supported in a substantially horizontal orientation by the outer circumferential bearing surface of support 56. With auxiliary platform 62 attached, the mobile pedestal unit can still be conveniently parked under a primary worksurface, such as a desk as shown in FIG. 5.

Figure 9:
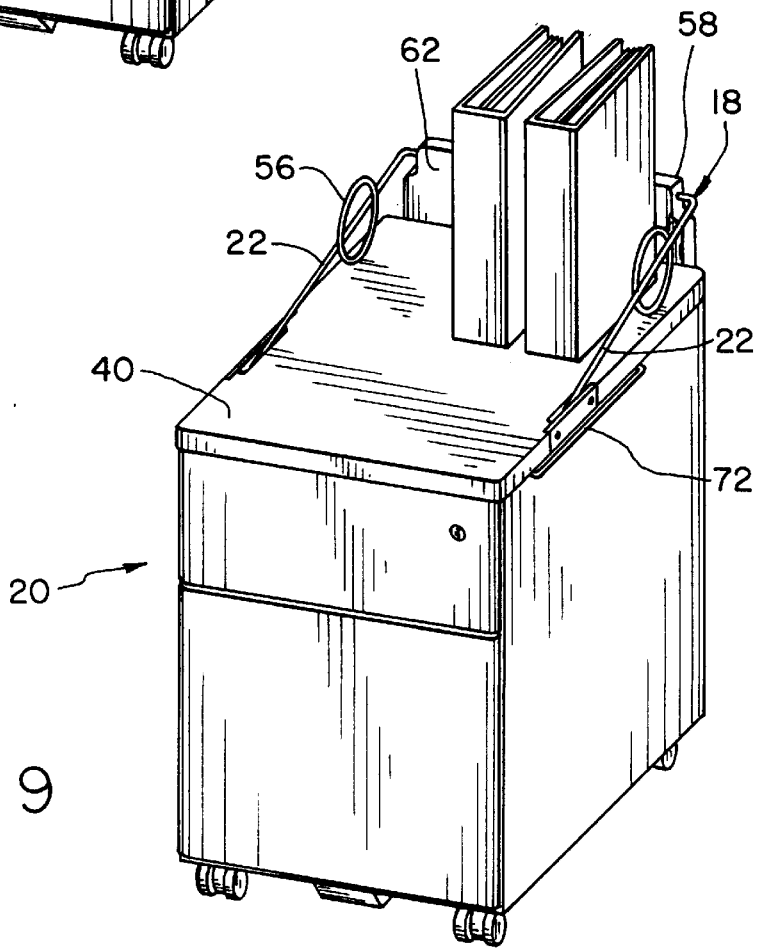
FIG. 9 is a perspective view of the mobile pedestal unit with the auxiliary platform being used as a bookstop.

Platform 62 may also be allowed to hang freely in a substantially vertical orientation. Arm member 18 is configured so that when arm member 18 is positioned above the rear edge of mobile pedestal unit 20, in a "storage" position, it projects only slightly beyond the rear edge of mobile pedestal unit 20 and when platform 62 hangs freely in a substantially vertical position the free end of platform 62 is positioned adjacent the rear exterior surface of unit 20. In this position, the floor area required by unit 20 is minimized and platform 62 can be used as a book stop as shown in FIG. 9.

Figure 10A:
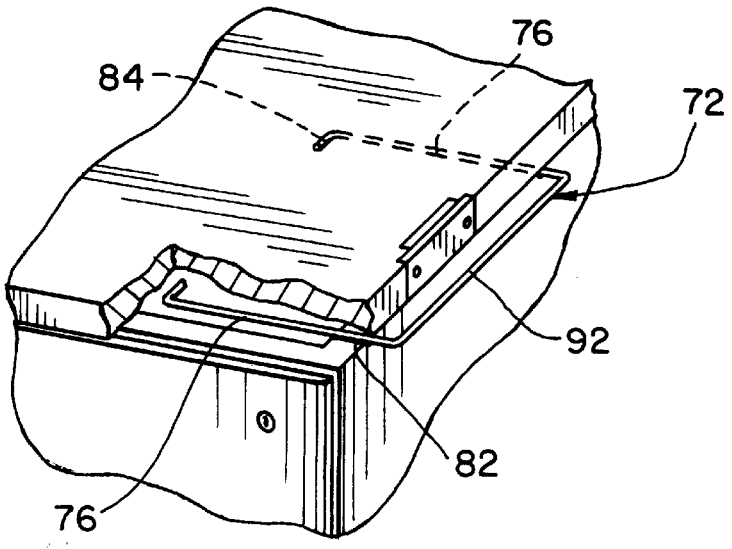
FIG. 10A is a partial perspective view of the mobile pedestal unit and a file support member with the top platform of the unit partially broken away.
Figure 10B:
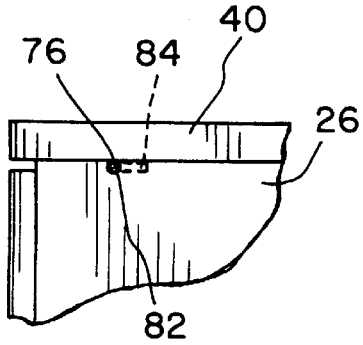
FIG. 10B is a partial cross sectional view of the mobile pedestal unit taken through the file support member.

As shown in FIGS. 1 and 10A, mobile pedestal unit 20 may also include a retractable file support member 72 for supporting hanging files 74. In one form, file hanger 72 is a substantially U-shaped heavy gage wire having two parallel support rails 76, a cross member 92 and two retaining members 84. As shown in FIG. 10B, the top of side panel 26 includes grooves 82 on its top edge into which support rails 76 of file hanger 72 are inserted before top panel 40 is installed. Upon installation of top panel 40, the file hanger is prevented from being removed from mobile pedestal unit 20 by retaining members 84 formed on interior ends of support rails 76 as shown in FIG. 10B. Thus file hanger 72 is slidable in grooves 82 between an extended position in which files may be hung from support rails 76 as shown in FIG. 6, to a retracted position in which support rails 76 are disposed substantially within mobile pedestal unit 20 and cross member 92 is disposed adjacent side panel 26 as shown in FIG. 8. File hanger 72 thereby provides file storage capability which supplements that provided by the drawers of mobile pedestal unit 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mobile office furniture pedestal unit comprising:

a mobile pedestal unit body having an upper surface with front and rear edges;

a plurality of wheeled members attached to said body and adapted to provide movable support for said body;

at least one storage compartment in said body;

an arm member pivotally attached to said body, said arm member having a grip portion, pivotal movement of said arm member selectively repositioning said grip portion relative to said body to at least two discrete positions, whereby said mobile pedestal unit can be pushed using said grip portion when in one of said positions; and a support member attached to said arm member, said support member having first and second bearing surfaces, said bearing surfaces disposed above said upper surface and on opposite sides of said arm member; whereby pivoting of said arm member toward said front edge engages said first bearing surface with said upper surface and pivoting of said arm member toward said rear edge engages said second bearing surface with said upper surface.

2. The pedestal unit of claim 1 wherein said arm member comprises a pair of pivot arms, each of said pivot arms rotatable about a common axis, said pivot arms connected at a point spaced from said common axis whereby said pivot arms pivot in unison.

3. The pedestal unit of claim 2 wherein said grip portion comprises a sleeve attached to each of said pivot arms.

4. The pedestal unit of claim 1 wherein, said at least two discrete positions comprise a projecting position and a storage position, said grip portion disposed above and horizontally outward of said front edge in said projecting position, said grip portion being disposed relatively proximate said rear edge in said storage position.

5. The pedestal unit of claim 1 wherein said upper surface comprises a generally rectangular shape, said front and rear edges being substantially parallel;

said arm member comprises a pair of pivot arms, said pivot arms rotatable about a common axis, said pivot arms connected at a point spaced from said common axis whereby said pivot arms pivot in unison, said common axis disposed substantially parallel to and between said front and rear edges, said common axis spaced a first distance from said front edge and a second distance from said rear edge, said first distance being less than said second distance whereby said selective repositioning includes said grip portion having a projectable position beyond said front edge and said grip portion having a retracted position relatively proximate said rear edge.

6. The pedestal unit of claim 5 further comprising an auxiliary platform rotatably attached to said arm member proximate said grip portion, said auxiliary platform rotatable about a platform axis disposed substantially parallel to said common axis whereby a free end of said auxiliary platform is positioned adjacent said rear edge when said grip portion is in said retracted position and said auxiliary platform hangs freely in a substantially vertical orientation.

7. The pedestal unit of claim 1 further comprising an auxiliary platform rotatably attached to said arm member proximate said grip portion.

8. The pedestal unit of claim 7 wherein said upper surface comprises a generally rectangular surface, said front and rear edges being substantially parallel, opposite edges, said upper surface further comprising substantially parallel, opposite side edges;

said arm member rotates about a first axis, said grip portion disposed a first length from said first axis, said first axis disposed substantially parallel to said front and rear edges and between said opposite side edges, said first axis spaced from said rear edge at a distance approximately equivalent to said first length and spaced from said front edge at a lesser distance whereby said grip portion is positionable relatively proximate said rear edge and projectable beyond said front edge, said auxiliary platform having a free end rotatable about a platform axis, said platform axis being substantially parallel to said first axis, said free end being adjacent said rear edge when said grip portion is positioned proximate said rear edge, whereby said auxiliary platform hangs freely in a substantially vertical orientation; and wherein said support member is positionable above said upper surface between said front and rear edges whereby said auxiliary platform is supportable in a substantially horizontal orientation by engagement of said free end with said support member.

9. The pedestal unit of claim 1, wherein said support member comprises a circular member attached to said arm member, said bearing surfaces disposed on an outer circumferential surface of said circular member, said first bearing surface disposed approximately diametrically opposite said second bearing surface.

10. The pedestal unit of claim 1 further comprising a file support member, said file support member having two parallel support rails which are movable between a retracted position wherein said rails are disposed substantially within said mobile pedestal unit body and an extended position wherein said rails extend outwardly from an exterior surface of said pedestal unit body and are positioned to support hanging files thereon.

11. The pedestal unit of claim 10 wherein said parallel support rails are connected with a cross-member thereby forming a substantially U-shaped element.

12. An office furniture pedestal unit comprising:

a base structure having a storage compartment therein;

an arm member attached to said base structure, said arm member pivotal about a first axis whereby pivotal movement of said arm member about said first axis selectively repositions said arm member relative to said base structure;

an auxiliary platform rotatably attached to said arm member, said auxiliary platform rotatable about a platform axis, said auxiliary platform having a free end, said pivotal movement of said arm member repositioning said platform axis relative to said base structure; and a support member engageable with said base structure, said auxiliary platform movable to a first position wherein said support member engages a first side of said auxiliary platform to thereby support said auxiliary platform in a substantially horizontal orientation, said auxiliary platform movable to a second position wherein said first side of said auxiliary platform faces away from said support member and said platform is oriented substantially vertically.

13. The pedestal unit of claim 12, wherein said support member is attached to said arm member and said pivotal movement of said arm member repositions said support member.

14. The pedestal unit of claim 12, wherein said support member is attached to said arm member and has first and second support surfaces, said pivotal movement of said arm member engaging said first and said second support surfaces with said base structure.

15. The pedestal unit of claim 12, wherein said arm member comprises a pair of pivot arms, each of said pivot arms rotatable about said first axis, said pivot arms connected at a point spaced from said first axis whereby said pivot arms pivot in unison.

16. The pedestal unit of claim 12 further comprising at least one wheeled member attached to said base structure and adapted to provide support for said base structure whereby said pedestal unit is a mobile pedestal unit, and said arm member includes a grip portion.

17. The pedestal unit of claim 12 further comprising a file support member, said file support member having two parallel support rails which are movable between a retracted position wherein said rails are disposed substantially within said base structure and an extended position wherein said rails extend outwardly from an exterior surface of said pedestal unit body and are positioned to support hanging files thereon.

18. The pedestal unit of claim 17 wherein said parallel support rails are connected with a cross-member thereby forming a substantially U-shaped element.

19. The pedestal unit of claim 18, further comprising a drawer.

20. The office furniture pedestal unit of claim 12, wherein said platform is movable to a third position wherein said first side of said platform faces away from said support member and said platform is oriented substantially horizontally.

21. A mobile office furniture pedestal unit comprising:

a mobile pedestal unit body having a generally rectangular upper surface, said upper surface having substantially parallel front and rear edges and substantially parallel opposite side edges;

a plurality of wheeled members attached to said body and adapted to provide movable support for said body;

at least one storage compartment in said body;

an arm member pivotally attached to said body, said arm member having a grip portion, pivotal movement of said arm member selectively repositioning said grip portion relative to said body to at least two discrete positions, whereby said mobile pedestal unit can be pushed using said grip portion when in one of said positions, said arm member comprising a pair of pivot arms, said pivot arms rotatable about a common axis, said pivot arms connected at a point spaced from said common axis whereby said pivot arms pivot in unison, said common axis disposed substantially parallel to and between said front and rear edges, said common axis spaced a first distance from said front edge and a second distance from said rear edge, said first distance being less than said second distance whereby said selective repositioning includes said grip portion having a projectable position beyond said front edge and said grip portion having a retracted position relatively proximate said rear edge; and an auxiliary platform rotatably attached to said arm member proximate said grip portion, said auxiliary platform rotatable about a platform axis disposed substantially parallel to said common axis whereby a free end of said auxiliary platform is positioned adjacent said rear edge when said grip portion is positioned in said retracted position and said auxiliary platform hangs freely in a substantially vertical orientation.

22. A mobile office furniture pedestal unit comprising:

a mobile pedestal unit body having a generally rectangular upper surface, said upper surface having front and rear substantially parallel, opposite edges and substantially parallel, opposite side edges;

a plurality of wheeled members attached to said body and adapted to provide movable support for said body;

at least one storage compartment in said body; and an arm member pivotally attached to said body, said arm member having a grip portion, pivotal movement of said arm member selectively repositioning said grip portion relative to said body to at least two discrete positions, whereby said mobile pedestal unit can be pushed using said grip portion when in one of said positions;

an auxiliary platform rotatably attached to said arm member proximate said grip portion;

said arm member rotating about a first axis, said grip portion disposed a first length from said first axis, said first axis disposed substantially parallel to said front and rear edges and between said opposite side edges, said first axis spaced from said rear edge at a distance approximately equivalent to said first length and spaced from said front edge at a lesser distance whereby said grip portion is positionable relatively proximate said rear edge and projectable beyond said front edge, said auxiliary platform having a free end rotatable about a platform axis, said platform axis being substantially parallel to said first axis, said free end being adjacent said rear edge when said grip portion is positioned proximate said rear edge, whereby said auxiliary platform hangs freely in a substantially vertical orientation; and a support member positionable above said upper surface between said front and rear edges whereby said auxiliary platform is supportable in a substantially horizontal orientation by engagement of said free end with said support member.

23. A mobile office furniture pedestal unit comprising:

a mobile pedestal unit body;

a plurality of wheeled members attached to said body and adapted to provide movable support for said body;

at least one storage compartment in said body; and an arm member pivotally attached to said body and pivotal about an axis, said arm member having a grip portion, pivotal movement of said arm member selectively repositioning said grip portion relative to said body to at least two discrete positions, whereby said mobile pedestal unit can be pushed using said grip portion when in one of said positions; and a file support member having two parallel support rails which are movable between a retracted position wherein said rails are disposed substantially within said mobile pedestal unit body and an extended position wherein said rails extend outwardly from an exterior surface of said pedestal unit body and are positioned to support hanging files thereon;

said axis being disposed intermediate said rails.

24. The pedestal unit of claim 23, wherein said file support member is a substantially U-shaped element having a cross-member connecting said parallel rails, each of said parallel rails slidably disposed in an opening in a side of said pedestal unit body, and a retaining member extending at an angle from each of said parallel rails at interior ends of said rails opposite said cross-member whereby said retaining members engage an interior surface of said pedestal unit body upon extension of said file support member and thereby prevent removal of said file support member.

25. The pedestal unit of claim 23, wherein said parallel support rails are connected with a cross-member thereby forming a substantially U-shaped element.

26. An office furniture pedestal unit comprising:

a base structure having a storage compartment therein;

an arm member attached to said base structure, said arm member pivotal about a first axis whereby pivotal movement of said arm member about said first axis selectively repositions said arm member relative to said base structure;

an auxiliary platform rotatably attached to said arm member, said auxiliary platform rotatable about a platform axis, said auxiliary platform having a free end, said pivotal movement of said arm member repositioning said platform axis relative to said base structure;

a support member engageable with said base structure and having a support surface, said arm member and said auxiliary platform movable to a position whereby said support surface engages said auxiliary platform to thereby support said auxiliary platform in a substantially horizontal orientation; and a file support member having two parallel support rails which are movable between a retracted position wherein said rails are disposed substantially within said base structure and an extended position wherein said rails extend outwardly from an exterior surface of said pedestal unit body and are positioned to support hanging files thereon;

said first axis being disposed intermediate said rails.

27. The pedestal unit of claim 26 wherein said parallel support rails are connected with a cross-member thereby forming a substantially U-shaped element.

28. The pedestal unit of claim 27, further comprising a drawer.

29. A wheeled office furniture pedestal unit comprising:

a base structure having a storage compartment therein;

an arm member pivotally attached to said base structure; and an auxiliary platform rotatably attached to said arm member, said auxiliary platform rotatable about a platform axis;

said auxiliary platform movable to a first substantially horizontal position wherein said platform is positioned above and substantially inwardly of a side of said base structure, said auxiliary platform movable to an alternate substantially horizontal position wherein said platform is positioned above and is cantilevered over said base structure.

* * * * *